US008567065B2

(12) United States Patent
Mardkha

(10) Patent No.: US 8,567,065 B2
(45) Date of Patent: Oct. 29, 2013

(54) METHOD OF AUGMENTING A RING

(76) Inventor: Joseph Mardkha, Great Neck, NY (US)

( * ) Notice: Subject to any disclaimer, the term of this patent is extended or adjusted under 35 U.S.C. 154(b) by 105 days.

(21) Appl. No.: 12/813,196

(22) Filed: Jun. 10, 2010

(65) Prior Publication Data

US 2011/0302958 A1 Dec. 15, 2011

(51) Int. Cl.
*A44C 27/00* (2006.01)

(52) U.S. Cl.
USPC ..... 29/896.412; 29/896.4; 29/401.1

(58) Field of Classification Search
USPC ..... 63/15–15.9, 28; D11/26, 34, 37–38; 29/10, 896.4, 896.41, 896.411, 29/896.412, 401.1
See application file for complete search history.

(56) References Cited

U.S. PATENT DOCUMENTS

| | | | | | |
|---|---|---|---|---|---|
| 802,267 | A | * | 10/1905 | Chaumet | 63/28 |
| 1,422,819 | A | * | 7/1922 | Blaicher | 63/15 |
| 1,428,158 | A | * | 9/1922 | Fuermann | 63/15 |
| D83,719 | S | * | 3/1931 | Burgess | D11/34 |
| 1,863,617 | A | * | 6/1932 | Brogan | 63/15 |
| D88,984 | S | * | 1/1933 | Peterson | D11/38 |
| D94,476 | S | * | 2/1935 | Granat | D11/34 |
| 2,182,876 | A | | 12/1939 | Moldenhauer | |
| D136,698 | S | * | 11/1943 | Sacks | D11/34 |
| 2,610,385 | A | * | 9/1952 | Manne | 29/10 |
| D203,551 | S | * | 1/1966 | Tranfield | D11/26 |
| 3,321,934 | A | * | 5/1967 | Boyd | 63/1.14 |
| 3,751,795 | A | | 8/1973 | Favre | |
| 4,821,533 | A | * | 4/1989 | Bonnefoy | 63/3 |
| 4,989,420 | A | | 2/1991 | Reinhold et al. | |
| 5,003,678 | A | * | 4/1991 | Oganesyan | 29/10 |
| D329,992 | S | * | 10/1992 | Dostourian | D11/34 |
| D345,715 | S | * | 4/1994 | Hundt | D11/4 |
| 5,377,506 | A | | 1/1995 | Tranzer | |
| 5,592,835 | A | * | 1/1997 | Herr | 63/4 |
| 5,765,398 | A | | 6/1998 | Bardisbanyan | |
| 5,806,158 | A | * | 9/1998 | Wang | 29/10 |
| D423,393 | S | * | 4/2000 | Morris | D11/26 |
| D442,509 | S | | 5/2001 | Yamanaka | |
| 6,253,433 | B1 | | 7/2001 | Barron | |
| 6,412,304 | B1 | | 7/2002 | Adelman | |
| 6,450,402 | B1 | | 9/2002 | Regev | |
| 6,484,536 | B1 | * | 11/2002 | Gould | 63/15.1 |
| 6,851,278 | B2 | | 2/2005 | Keenan | |
| 7,181,930 | B2 | | 2/2007 | Wainberg | |
| 7,419,083 | B1 | * | 9/2008 | Cheng | 228/122.1 |
| 7,693,751 | B2 | | 4/2010 | Aronson | |
| 7,885,862 | B1 | | 2/2011 | Vincent et al. | |
| 2002/0002842 | A1 | * | 1/2002 | Molfese | 63/15 |
| 2002/0108397 | A1 | * | 8/2002 | Muller et al. | 63/29.1 |
| 2002/0133431 | A1 | | 9/2002 | West et al. | |
| 2003/0177789 | A1 | | 9/2003 | Leuz | |

(Continued)

OTHER PUBLICATIONS

International Search Report and Written Opinion corresponding to PCT Application No. PCT/US2010/038163.

*Primary Examiner* — Jack W. Lavinder
*Assistant Examiner* — Abigail E Morrell
(74) *Attorney, Agent, or Firm* — Dickstein Shapiro LLP

(57) ABSTRACT

A method of augmenting a ring including the steps of: receiving the ring having markings on the inner surface thereof, creating a setting having a size and position defined by at least one of the markings, and placing a gemstone in the setting. The locations of the markings are determined by considering various factors, including the inner shank circumference, the number of gemstone sizes, and the number of non-marking areas.

13 Claims, 24 Drawing Sheets

(56) References Cited

U.S. PATENT DOCUMENTS

| | | | | |
|---|---|---|---|---|
| 2005/0261989 | A1 | 11/2005 | Vadon et al. | |
| 2005/0288940 | A1 | 12/2005 | Cushman | |
| 2007/0095105 | A1* | 5/2007 | Dagesian et al. | 63/28 |
| 2007/0137250 | A1* | 6/2007 | Kohl | 63/15.6 |
| 2007/0198494 | A1 | 8/2007 | Vadon | |
| 2007/0219960 | A1 | 9/2007 | Vadon et al. | |
| 2007/0250456 | A1 | 10/2007 | Braunwart | |
| 2008/0168800 | A1* | 7/2008 | Nisguretsky | 63/27 |
| 2008/0177639 | A1 | 7/2008 | Kuppersmith | |
| 2008/0197538 | A1* | 8/2008 | Miller | 264/332 |
| 2008/0235925 | A1* | 10/2008 | Hoover et al. | 29/10 |
| 2009/0071192 | A1* | 3/2009 | Bauman | 63/15 |
| 2009/0144174 | A1 | 6/2009 | Reddy | |
| 2009/0299877 | A1 | 12/2009 | Vadon | |
| 2012/0101830 | A1 | 4/2012 | Dholakiya | |

* cited by examiner

METHOD OF AUGMENTING A RING

BACKGROUND

This invention relates to a ring with markings for identifying positions for setting gemstones in the future and to a method for marking the ring for the purpose of setting such gemstones in the marked positions.

Jewelers and jewelry vendors may benefit from repeated visits from customers. Those who purchase or wear jewelry, especially jewelry celebrating an event such as a wedding, may enjoy commemorating each anniversary of the event by adding a gemstone at the end of each year of marriage. Therefore, it may be desirable to provide a ring with markings identifying positions for setting such gemstones in the future so as the gemstones are set into the ring on each anniversary of the event, the gemstones will be properly sized and spaced. As time passes, the purchaser or wearer may return to the jeweler on the anniversary of such event to purchase and have a gemstone set in a predetermined and marked positions of the ring. Repeat visits to set such gemstones may also provide the jeweler with additional opportunities to sell other goods and services during such visits.

Adding gemstones to a ring without such markings would require the jeweler to identify a location for the new gemstone, then drill the ring to accommodate the new gemstone. The jeweler could misjudge, miscalculate or otherwise lack the precision necessary to ensure that the new gemstone(s) would be correctly sized and spaced to accommodate all the gemstones that may be desirably placed in the ring in the future. Further, because these tasks would need to be repeated each time a gemstone was added to a ring, possibly over the course of many years, there is an increased likelihood that mistakes in sizing or spacing of the gemstones would result in an unattractive ring or there will be insufficient space to include all desired gemstones. Further still, because new gemstones may be added by different jewelers, quality and aesthetic sensibilities may vary from one jeweler to the next, with each jeweler doing things differently from the last. This would risk asymmetry in size, spacing, and location of new gemstones that could negatively affect the beauty of the ring. Therefore, to ensure the gemstones are sized and placed properly, it may be desirable to create a pattern for the gemstones, then mark the ring accordingly. Markings could take into account milestones, such as the wedding itself, and five, ten, twenty-five, and fifty year anniversaries, and provide for different gemstones, for example, different types, colors, sizes, and varieties, for such milestones.

In a ring where gemstones are added over time, there may be marked positions that are not yet occupied by gemstones such that if the markings are on the outside of the shank, the ring may appear unfinished or incomplete. In light of this, or because the wearer may wish to maintain privacy, it may be desirable to place the markings and the gemstones on an inner surface of the shank of the ring that will not be visible to others when the ring is worn.

Placing markings on an inner surface of the ring may pose special challenges to a jeweler. For example, inner surface placement of a preferred number of gemstones may be affected by the size and number of the gemstones, by the width and size (inner circumference) of the ring, and by a stamping area where no gemstones are present. Conversely, outer surface placement of a preferred number of gemstones may be more easily accomplished at least because no stamping area is present on the outer surface and because ring size (inner circumference) may be reduced as a limiting factor because material may be added to the ring to increase ring height and outer circumference to provide more area to accommodate gemstones.

Given the above-described challenges, it is desirable to have a ring and method for marking a ring that provides a technique for making the desired marks on an inner surface of a ring in a reliable, repeatable manner and for automating the process for production purposes across various ring sizes and types.

SUMMARY OF THE DISCLOSURE

A ring including a shank having indicators at predetermined locations on an inner surface of the shank, where the indicators identify preferred positions for setting gemstones. The preferred positions may be based on the number of and sizes of the gemstones and/or on a predetermined pattern.

DETAILED DESCRIPTION

Figure 1A:
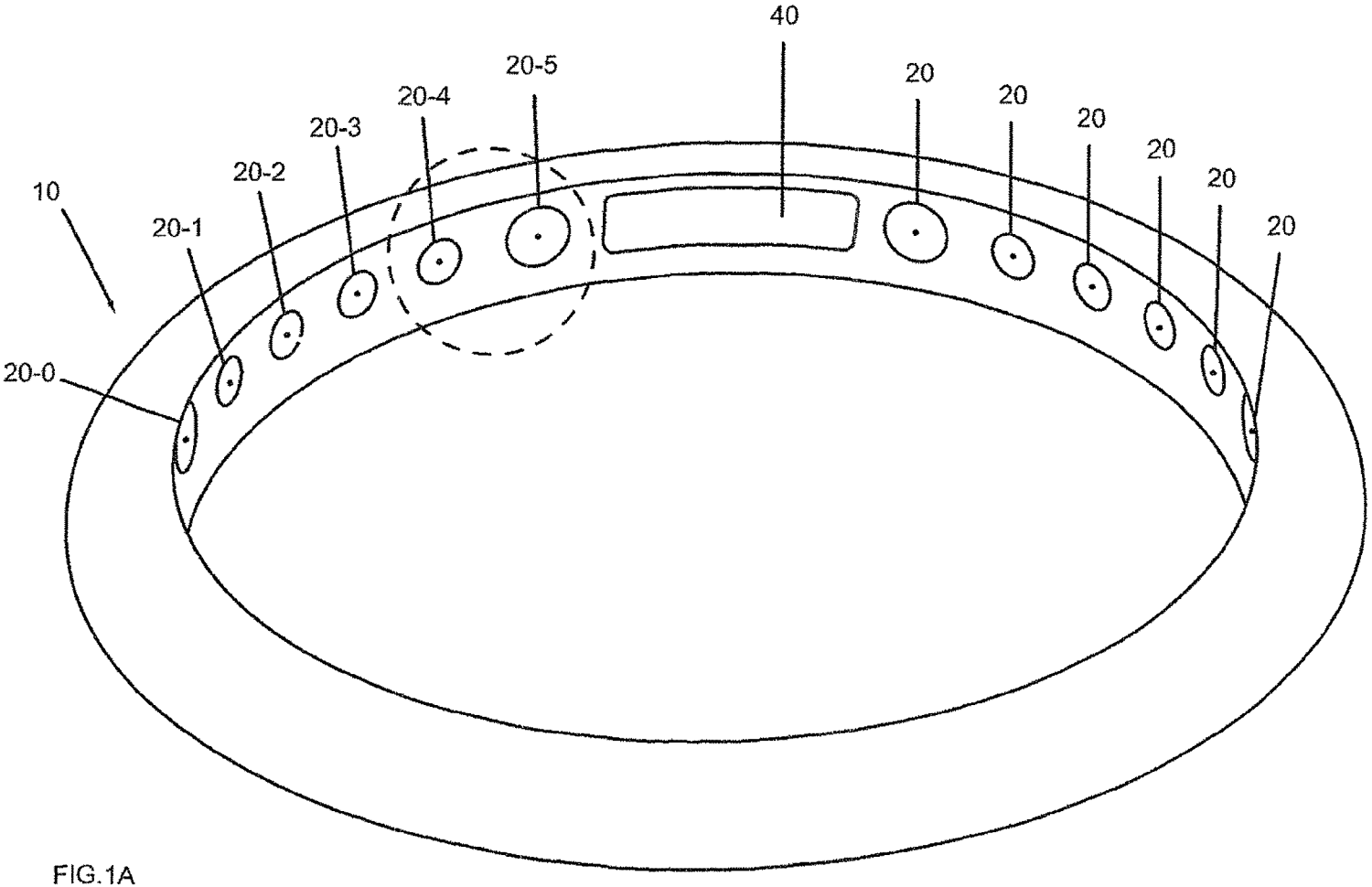
FIG. 1A shows a perspective view of a ring of the present disclosure.

The ring and method of the present disclosure may be described in detail using the accompanying drawings, wherein like reference numerals represent identical or corresponding parts throughout the several views.

The Ring

FIG. 1A shows ring 10 with markings 20 as indicators for future placement of gemstones on an inner surface of ring 10. FIG. 1A also shows stamping area 40 which may include text, symbols or other graphics, such as personal engravings, indicators of origin or material composition of ring 10.

Ring 10 may be made of precious or non-precious material, including but not limited to platinum alloy, gold alloy, palladium alloy, silver alloy, or another alloy. Ring 10 may have a setting (not shown) to accommodate additional gemstones.

Figure 1B:
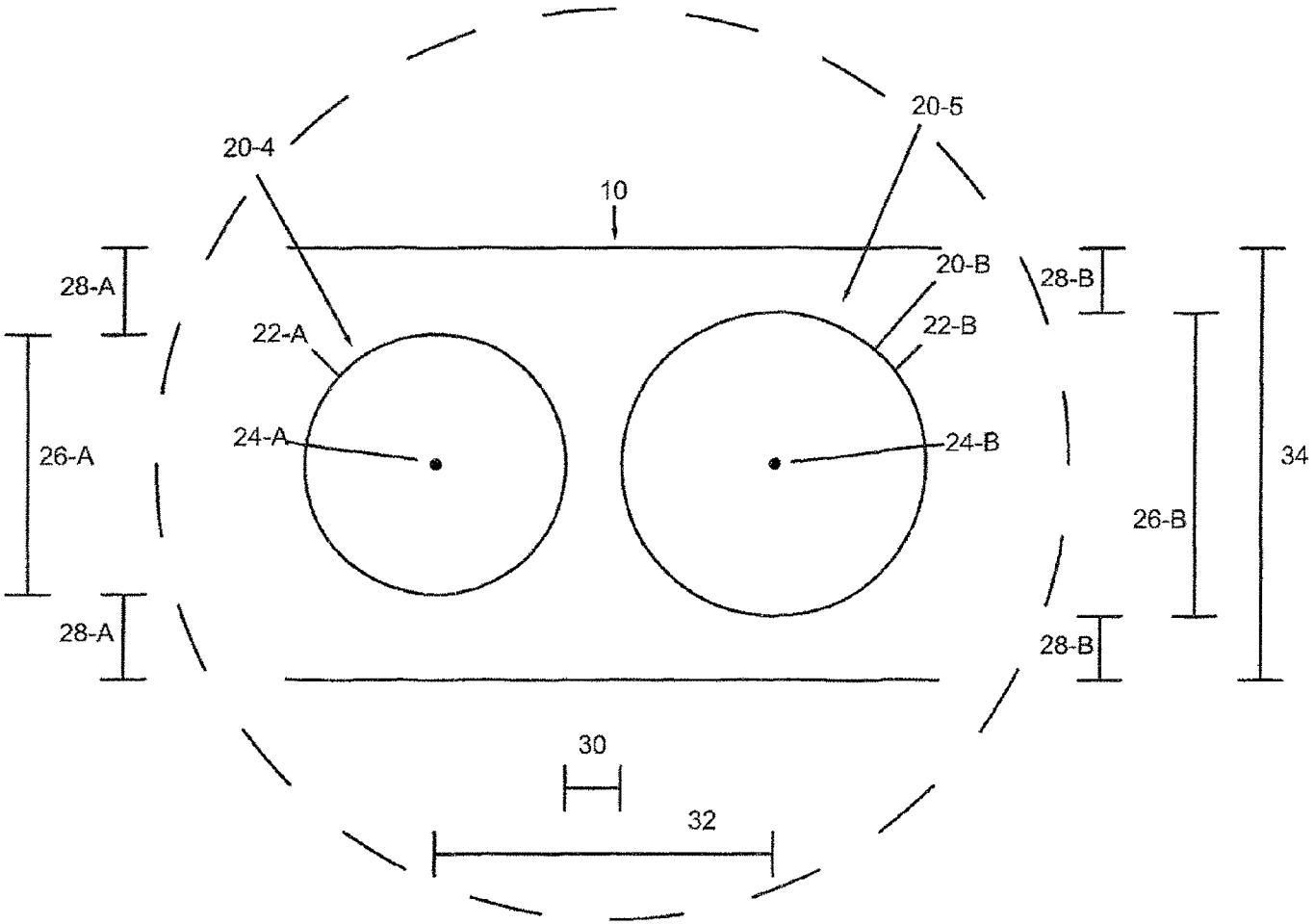
FIG. 1B shows a close up view of a portion of a ring of the present disclosure.

As shown in more detail in FIG. 1B, markings 20 may identify the location of gemstones and may be a symbol, such as a circle, or other identifier. Markings 20 may be provided to identify to jewelers the location and optionally the size or type of gemstone that may occupy the location in the future. Markings 20 may be sized or otherwise indicate or correspond to sizes of gemstones to be set. FIG. 1B shows markings 20-4 and 20-5. Marking 20-4 includes center point marking 24-A that may identify a center point of placement of a gemstone, and outer circle marking 22-A that may indicate a size of a gemstone that may occupy that location. That is, outer circle marking diameter 26-A may be a size approximately equal to the gemstone to occupy that location. In one non-limiting example, a location for an approximately 0.7 mm gemstone may be identified by marking 20-4 having center point marking 24-A placed at the center of the preferred gemstone location, with outer circle marking 22-A having outer circle marking diameter 26-A of approximately 0.7 mm.

Alternatively, outer circle marking diameter 26-A may be smaller or larger than the size of the gemstone to occupy that location. In other aspect, multiple outer circles may be used or no outer circle marking 22-A may be present.

FIG. 1B also shows distance from outer circle to ring edge 28-A for marking 20-4. FIG. 1B further shows second marking 20-5, for a gemstone larger than intended for marking 20-4, as illustrated by outer circle marking diameter 26-B, which is larger than 26-A, and distance from outer circle to ring edge 28-B, which is smaller than 28-A.

FIG. 1B further shows distance 30 between outer circle markings 22-A and 22-B, as well as distance 32 between center point markings 24-A and 24-B. Ring width 34 is also shown.

It will be understood that marking 20 may be other characters, symbols or graphics, such as a plus sign ("+") or asterisk ("*"). Marking 20 may be an indentation, engraving, or scoring.

Figure 2:
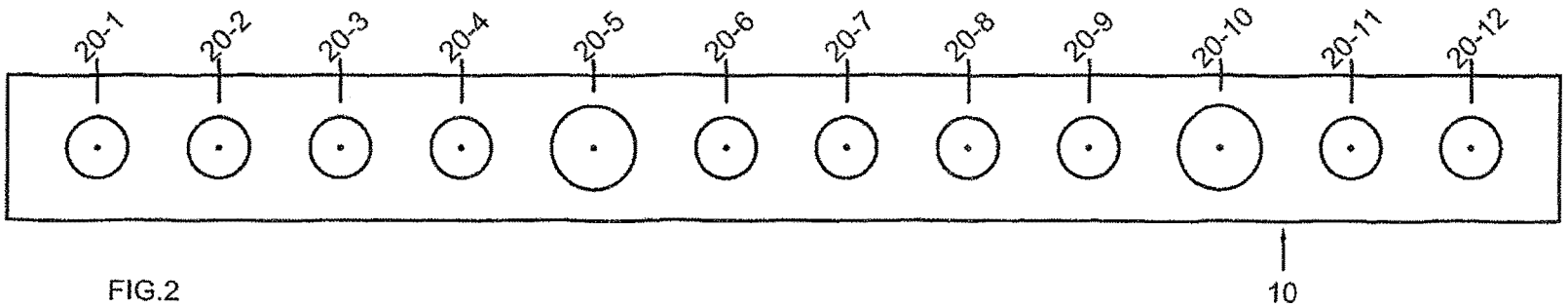
FIG. 2 shows a view of an inner surface of a ring of the present disclosure.

FIG. 2 shows an expanded view of a portion of an inner surface of ring 10 with a pattern of markings 20-1 through 20-12. The pattern shows four, smaller markings 20-1 to 20-4 followed by a fifth, larger marking 20-5. The pattern repeats for four, smaller markings 20-6 to 20-9 followed by marking 20-10, and this pattern may be repeated around inside of ring 10. In this non-limiting example, one smaller gemstone may be purchased and set at marking 20-1 to commemorate an event, such as an anniversary. Additional smaller gemstones may be purchased and set at markings 20-2 to 20-4 each year for four years. At the fifth year, a larger gemstone may be purchased and set at marking 20-5 to commemorate a fifth anniversary. Markings 20-6 to 20-9 indicate the position and size of smaller gemstones that may be purchased and set during years six through nine, while marking 20-10 indicates the position and size of a larger gemstone that may be purchased and set during year ten. Continuing with this example, larger gemstones may be purchased and set at the fifteenth and twentieth anniversaries, with smaller gemstones used in the intervening years. In yet another aspect, gemstones and markings may be the same size.

Figure 3B:
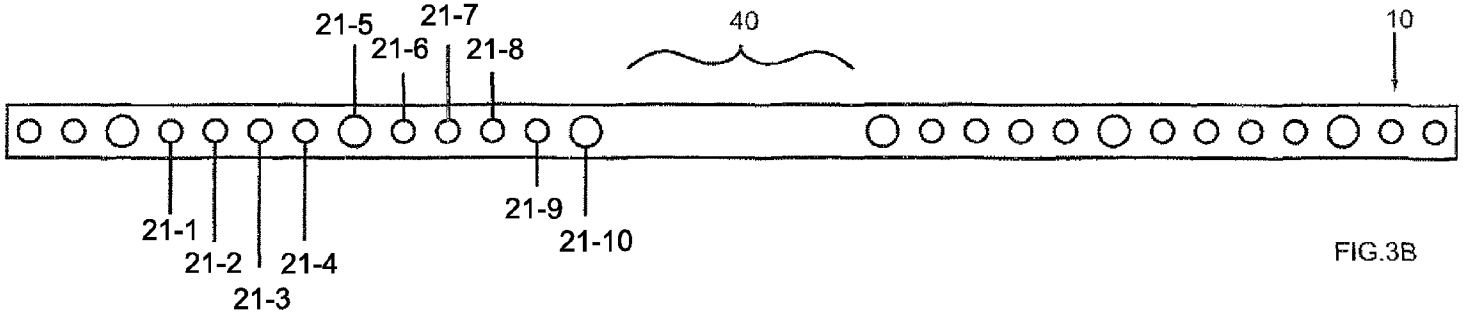
FIGS. 3A and 3B show perspective and expanded views of a ring of the present disclosure.
Figure 3A:
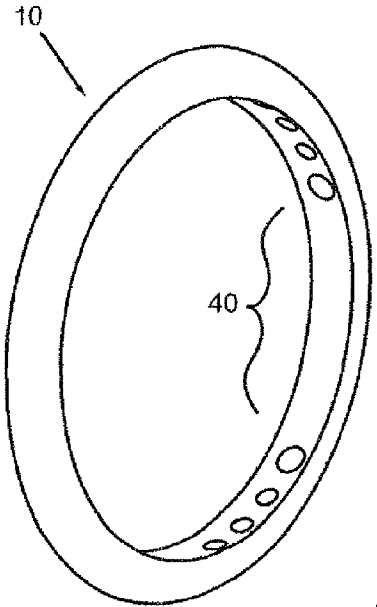
Figure 4:
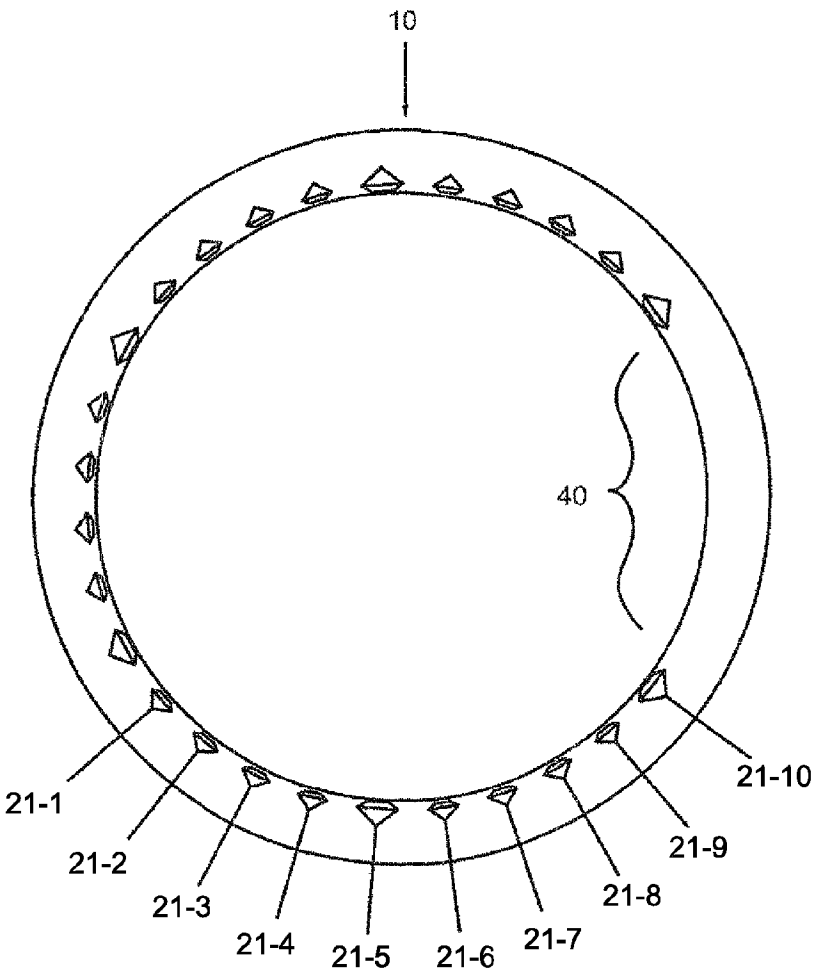
FIG. 4 shows a top, cross-section view of a ring of the present disclosure.

Views of ring 10 having 26 gemstones of two sizes and one stamping area are shown in FIGS. 3A, 3B, and 4. FIG. 4 shows a cross-sectional top view of ring 10 exposing embedded gemstones in the positions.

Figure 5B:
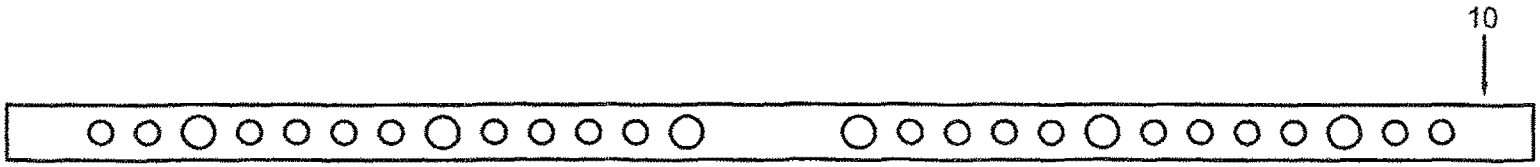
FIGS. 5A and 5B show perspective and expanded views of a ring of the present disclosure.
Figure 5A:
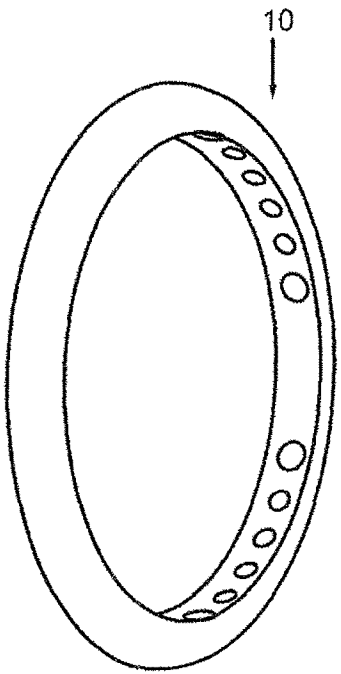
Figure 6:
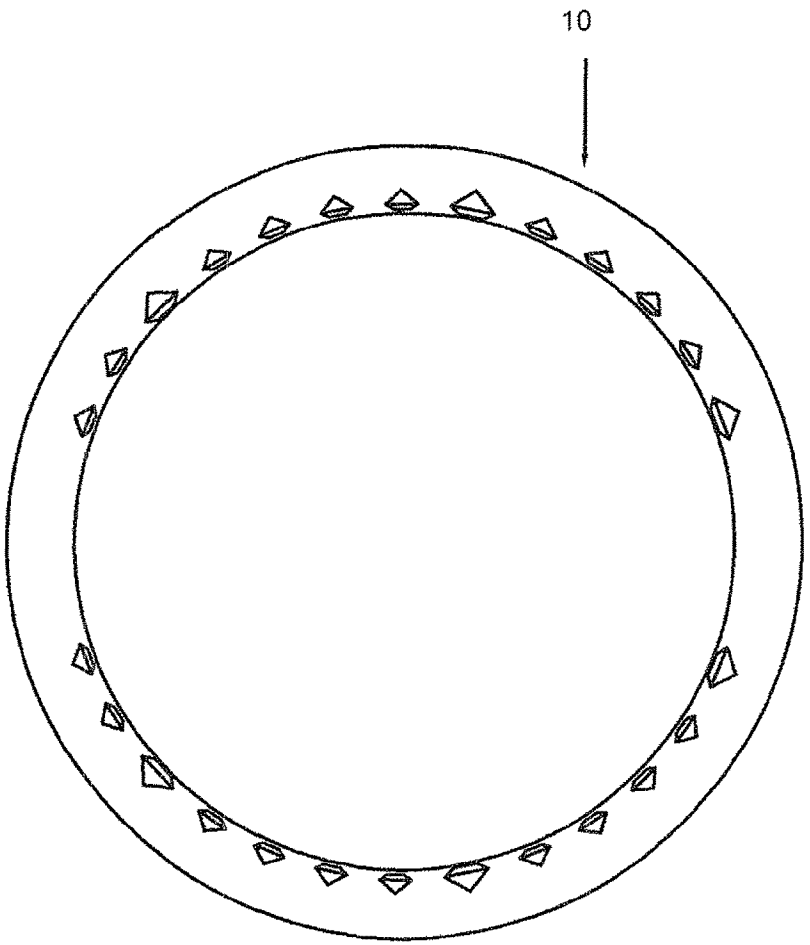
FIG. 6 shows a top, cross-section view of a ring of the present disclosure.
Figure 7:
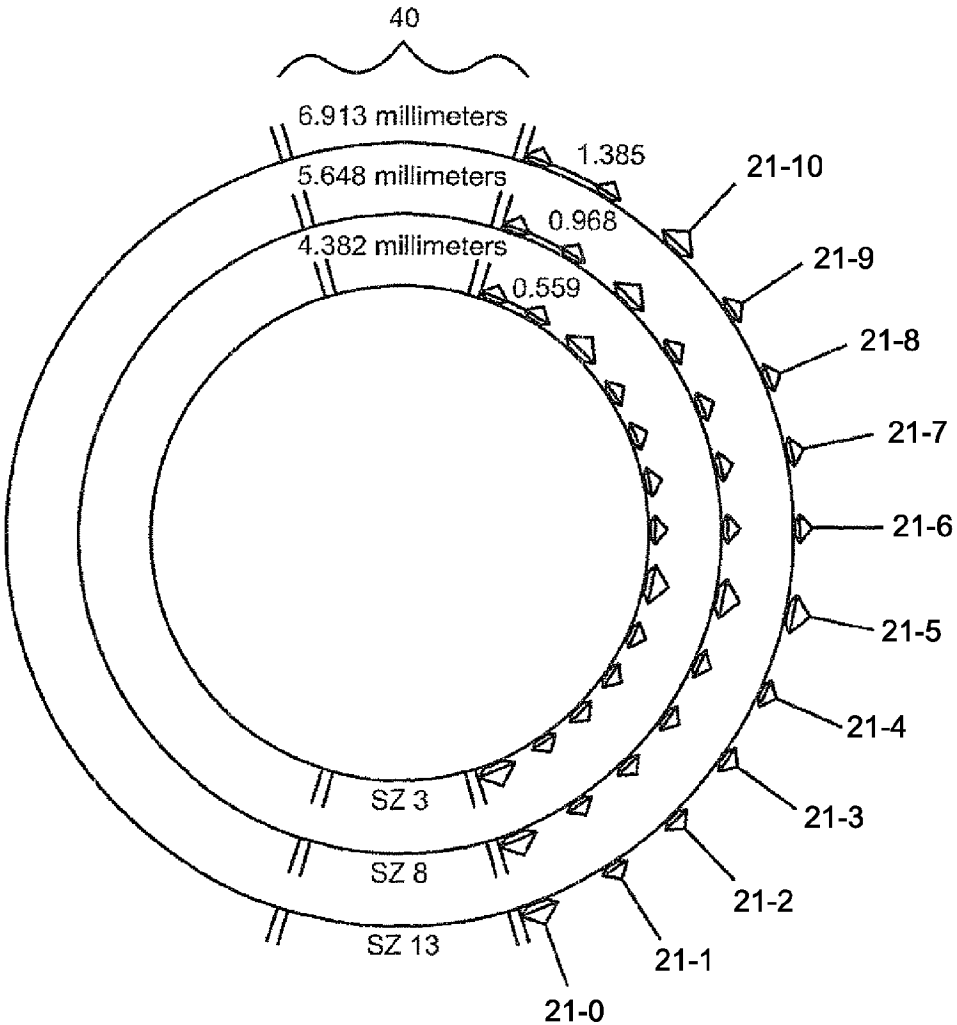
FIG. 7 shows views of gemstone locations for three ring sizes according to the present disclosure.

Views of ring 10 having 26 gemstones of two sizes and two stamping areas are shown in FIGS. 5A, 5B, and 6. FIG. 7 shows exemplary positions and sizes of gemstones for three ring sizes, each having 26 gemstones of two sizes and two stamping areas. In FIG. 7, all rings are 2.0 mm bands, small gemstones (for example, 21-1 to 21-4) are 0.8 mm, and large gemstones (for example, 21-0; 21-5; and 21-10) are 1.10 mm. Size 3 rings with this configuration have all gemstones set 0.559 mm apart, with 4.382 mm stamping areas. Size 8 rings with this configuration have all gemstones set 0.968 mm apart, with 5.648 mm stamping areas. Size 13 rings with this configuration have all gemstones set 1.385 mm apart, with 6.913 mm stamping areas.

Figure 8B:
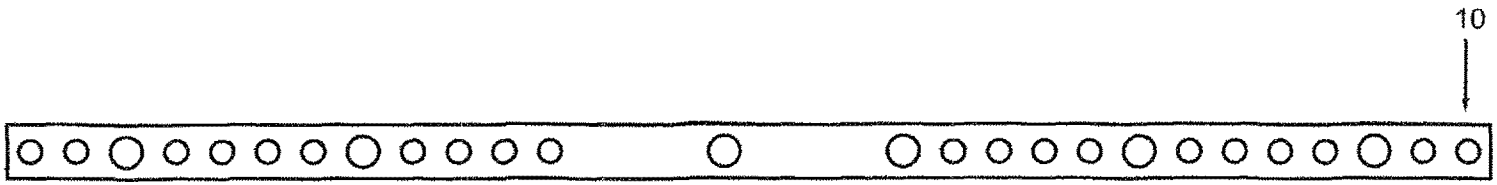
FIGS. 8A and 8B show perspective and expanded views of a ring of the present disclosure.
Figure 8A:
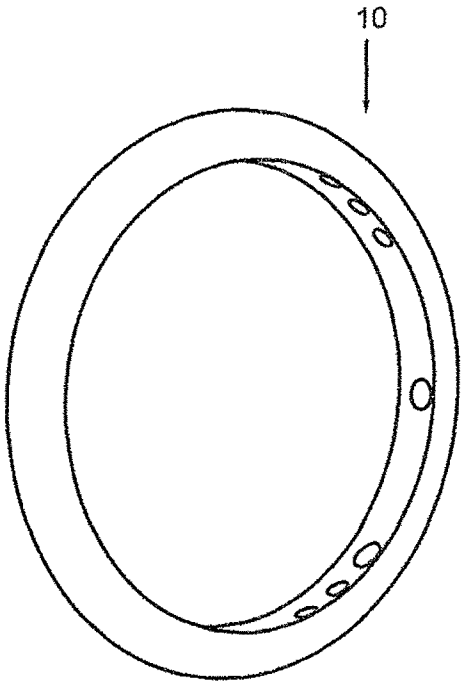
Figure 9:
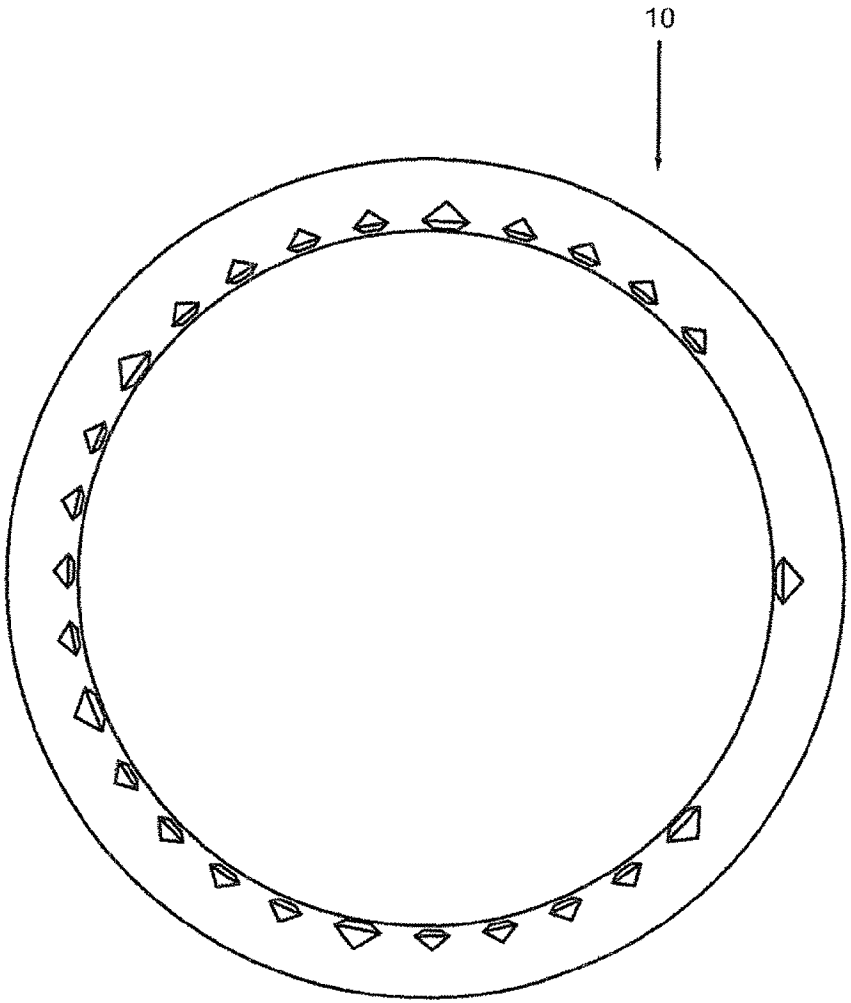
FIG. 9 shows a top, cross-section view of a ring of the present disclosure.

Views of ring 10 having 26 gemstones of two sizes and one stamping area with gemstone are shown in FIGS. 8A, 8B, and 9.

Figure 10B:
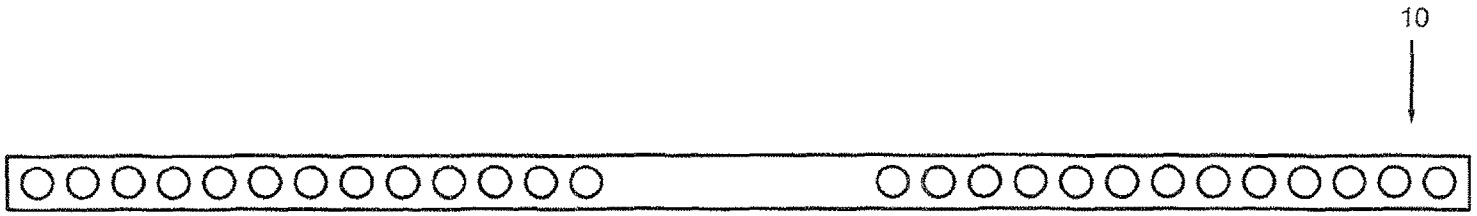
FIGS. 10A and 10B show perspective and expanded views of a ring of the present disclosure.
Figure 10A:
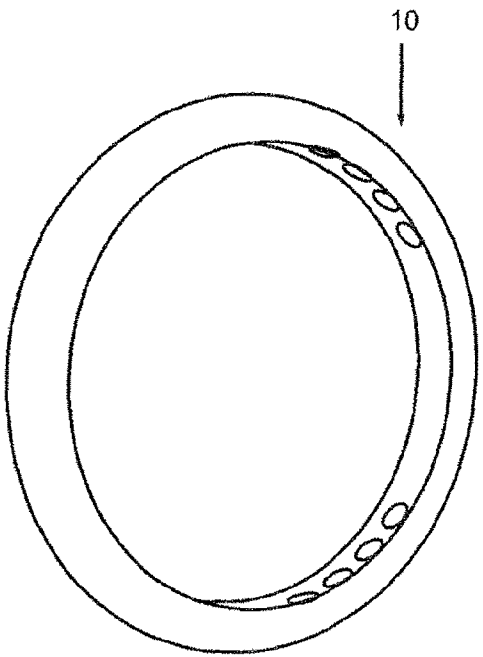
Figure 11:
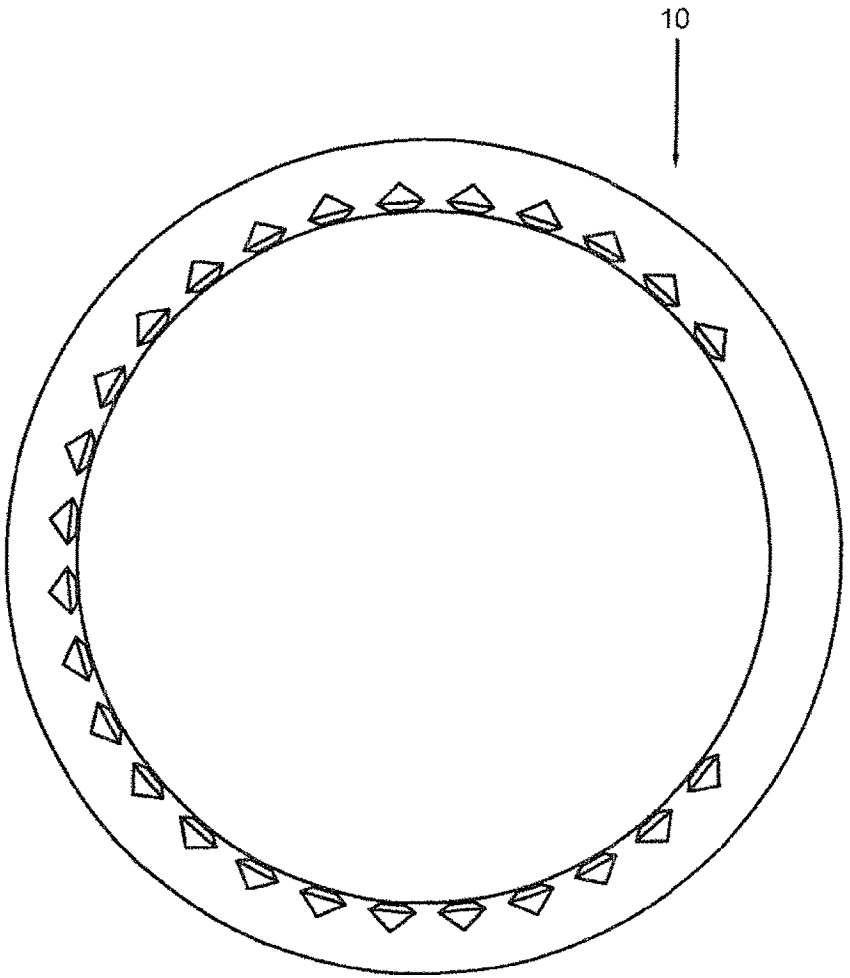
FIG. 11 shows a top, cross-section view of a ring of the present disclosure.
Figure 12B:
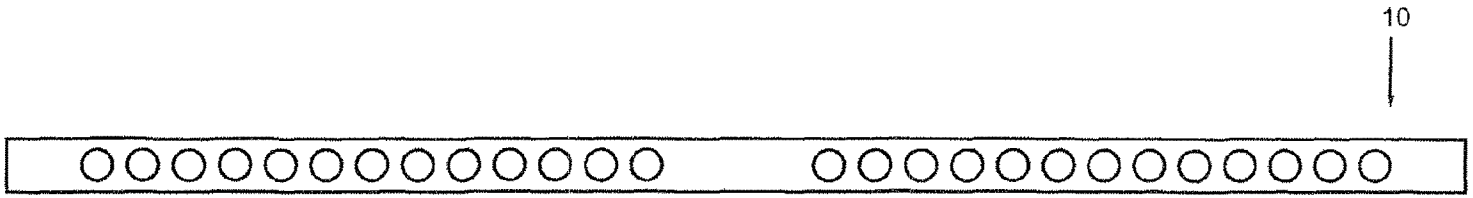
FIGS. 12A and 12B show perspective and expanded views of a ring of the present disclosure.
Figure 12A:
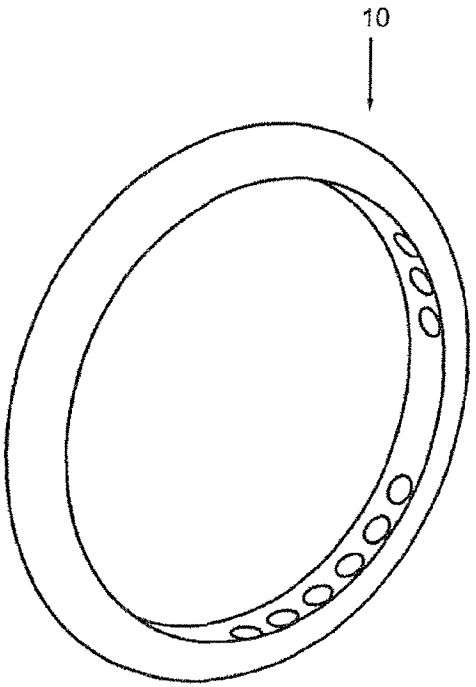
Figure 13:
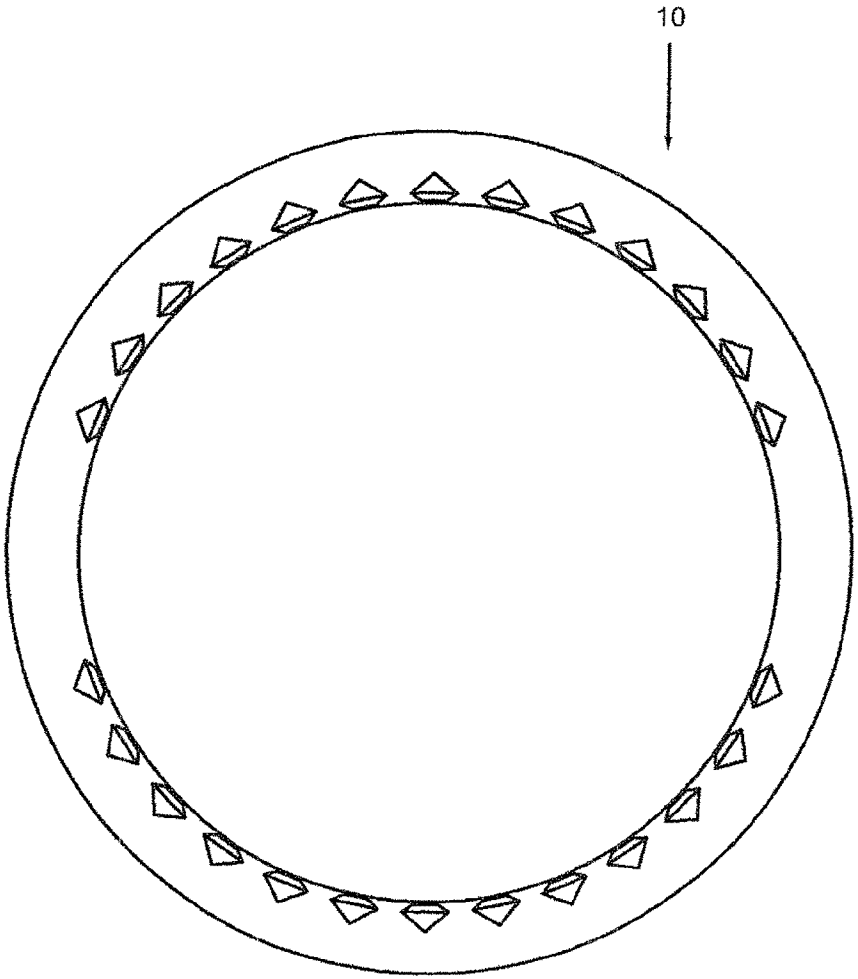
FIG. 13 shows a top, cross-section view of a ring of the present disclosure.
Figure 14B:
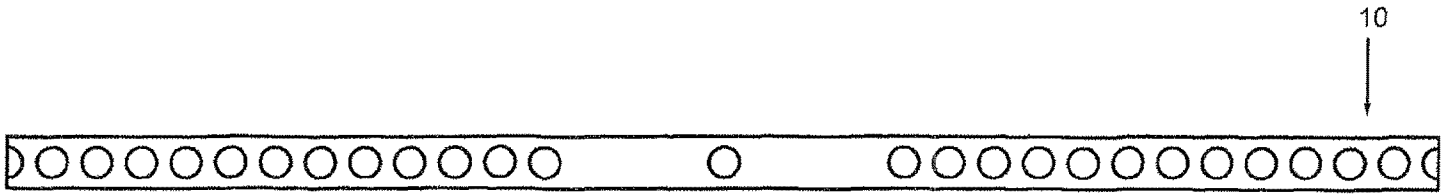
FIGS. 14A and 14B show perspective and expanded views of a ring of the present disclosure.
Figure 14A:
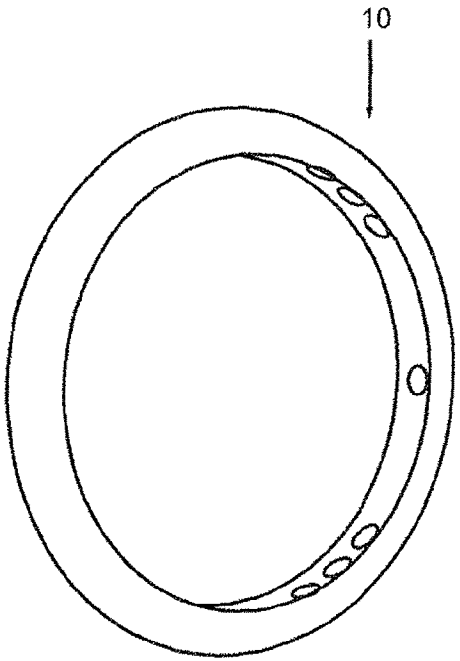
Figure 15:
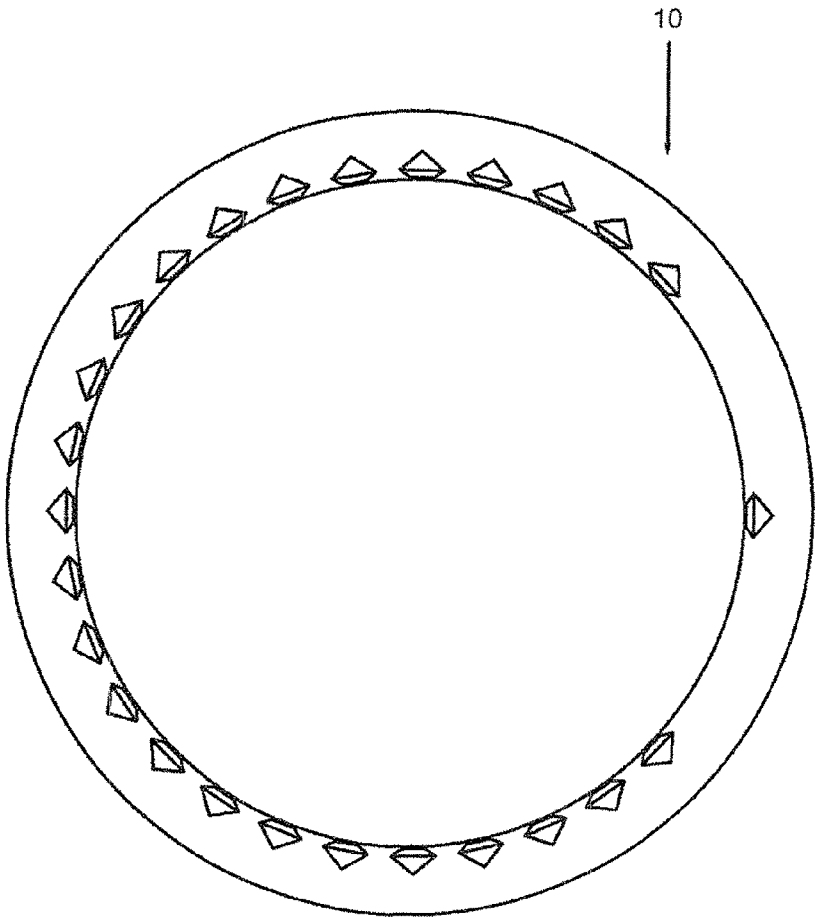
FIG. 15 shows a top, cross-section view of a ring of the present disclosure.

Views of ring 10 having 26 gemstones of one size and one stamping area are shown in FIGS. 10A, 10B, and 11. Views of ring 10 having 26 gemstones of one size and two stamping areas are shown in FIGS. 12A, 12B, and 13. Views of ring 10 having 26 gemstones of one size and one stamping area with gemstone are shown in FIGS. 14A, 14B, and 15.

Figure 16B:
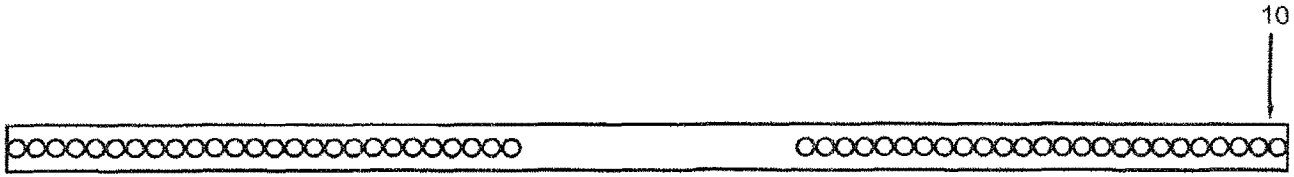
FIGS. 16A and 16B show perspective and expanded views of a ring of the present disclosure.
Figure 16A:
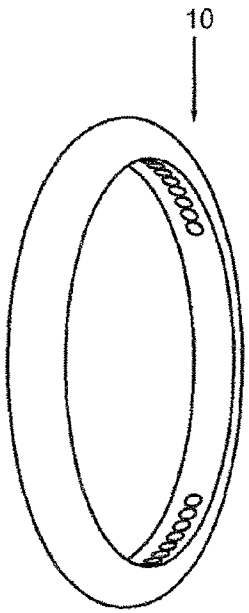
Figure 17:
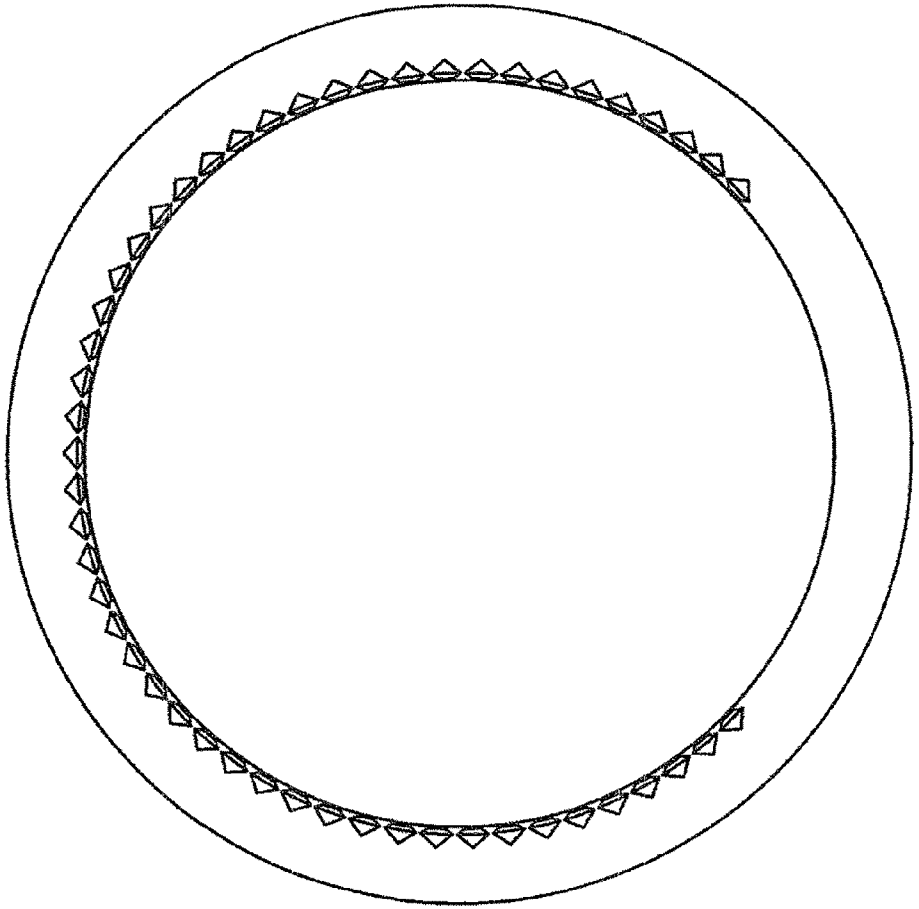
FIG. 17 shows a top, cross-section view of a ring of the present disclosure.
Figure 18B:
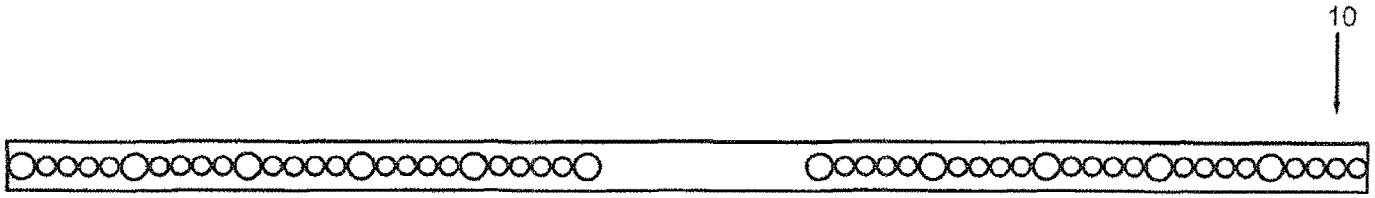
FIGS. 18A and 18B show perspective and expanded views of a ring of the present disclosure.
Figure 18A:
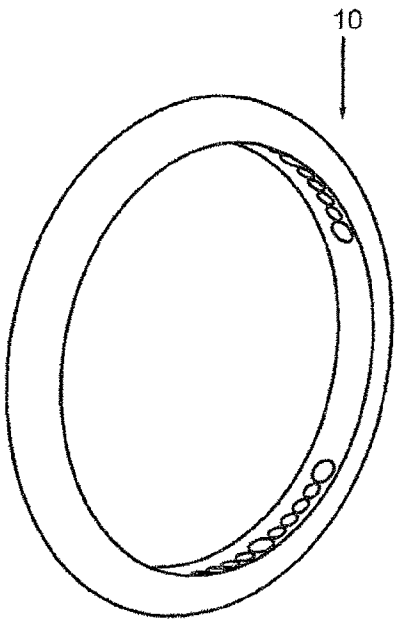
Figure 19:
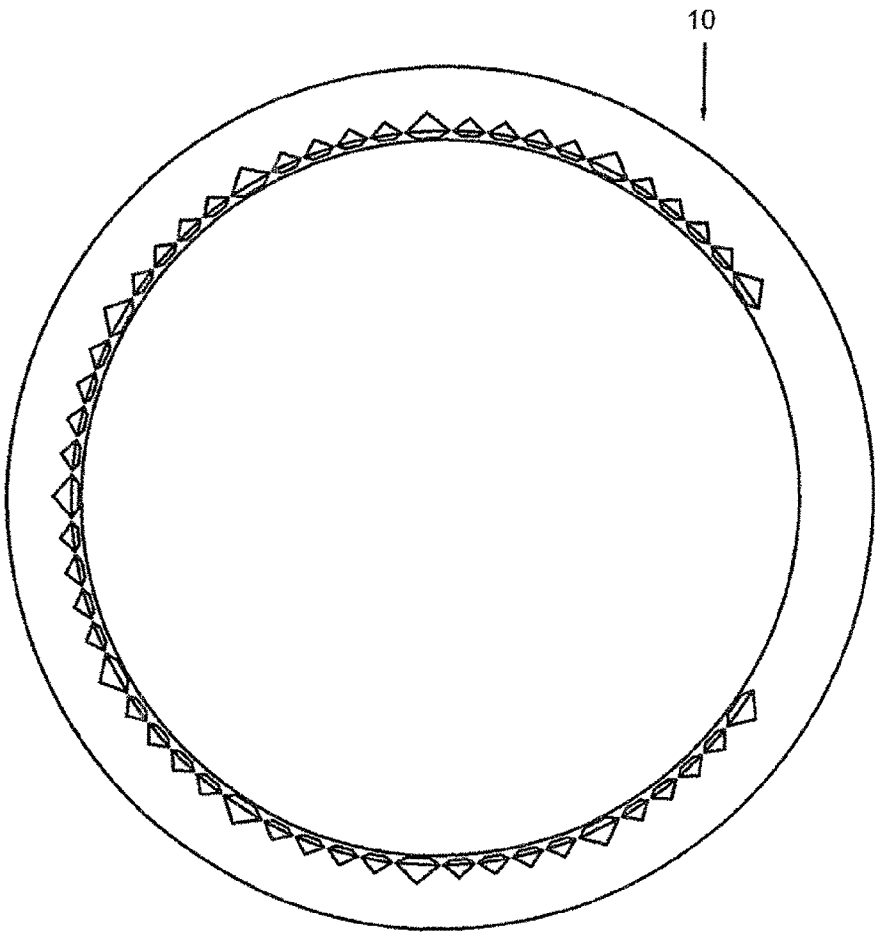
FIG. 19 shows a top, cross-section view of a ring of the present disclosure.

Views of ring 10 having 51 gemstones of one size and one stamping area are shown in FIGS. 16A, 16B, and 17. Views of ring 10 having 51 gemstones of two sizes and one stamping area are shown in FIGS. 18A, 18B, and 19. It will be understood that other arrangements of gemstones and stamping areas are available.

It will be understood that the number of gemstones in ring 10 may be any number. In two of the non-limiting examples discussed in more detail, 26 gemstones and 51 gemstones are shown. In those examples, one gemstone may be set to commemorate a wedding day, and the remaining 25 or 50 gemstones may be set to commemorate yearly anniversaries for the following 25 or 50 years respectively.

Ring Design and Manufacture

Figure 21:
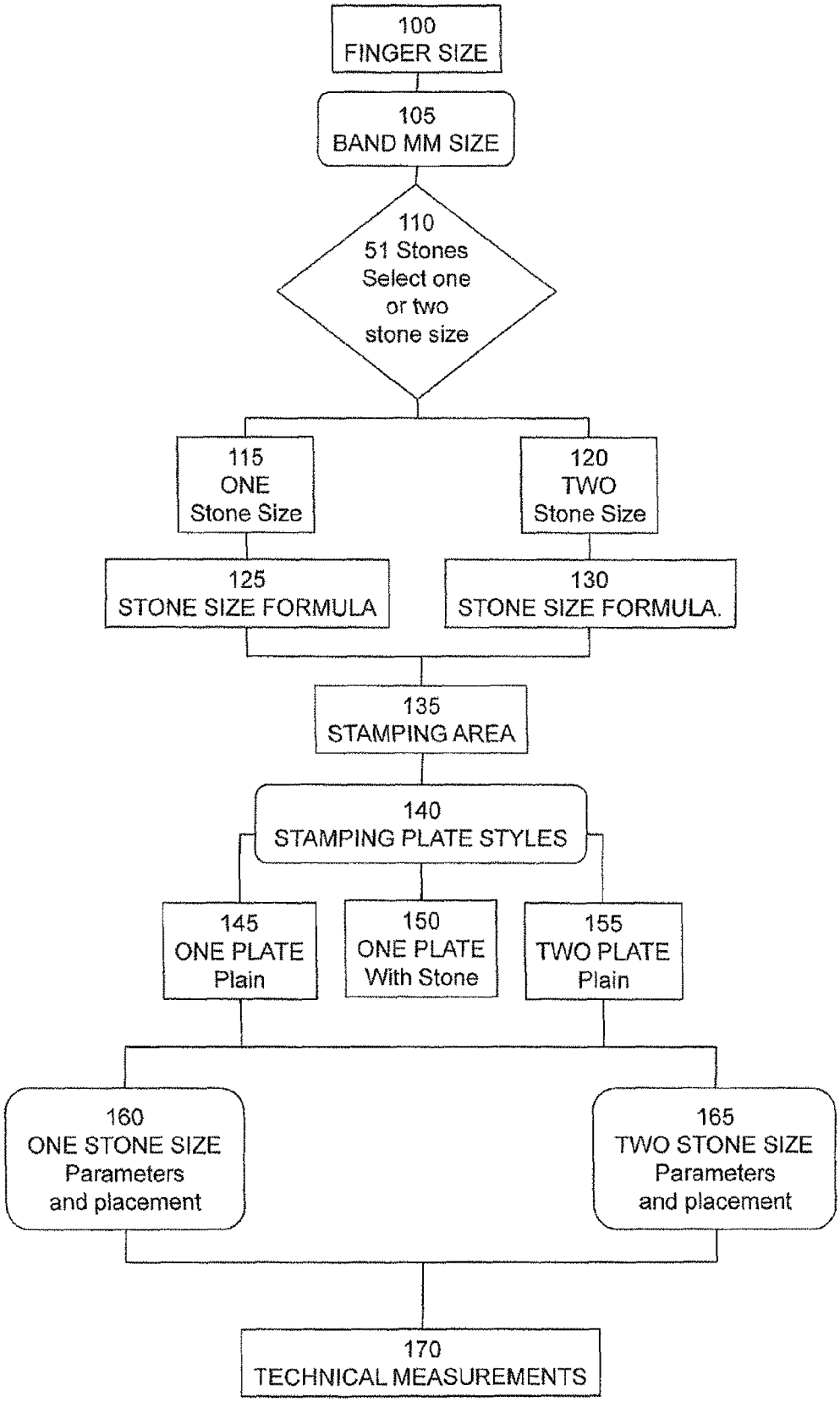
FIGS. 21 and 22 show flowcharts according to an aspect of the method of the present disclosure.

FIG. 21 shows a flowchart for a process for marking a ring for placement of 51 gemstones. A user may input finger size at Step 100 and width of ring 10 at Step 105. Step 110 indicates this process will determine placement of 51 gemstones. If a user selects that all gemstones are the same size at Step 115, then the process will use the placement formula in Step 125.

In Step 125, the process subtracts a minimum size of stamping area 40 from finger size circumference, and the difference is the available gemstone area. In one example, minimum size of stamping area 40 may be approximately 8.0 mm. The process multiplies the number of spaces between gemstones by the minimum space between gemstones then subtracts that amount from the available gemstone area to determine a preliminary largest possible gemstone size. In one example, the minimum space between gemstones may be 0.1 mm, and the number of spaces between gemstones for a 51 gemstone ring may be 50 spaces for a ring having one stamping area 40, or may be 49 spaces for a ring having two stamping areas 40. Gemstones having diameters smaller than the preliminary largest possible gemstone size may be used (or required) with the remaining area added to stamping area 40 in Step 135 or added to and/or distributed among the spaces between gemstones. In one aspect, when 51 gemstones of one size are selected, due to the generally smaller diameter of the gemstones that will fit in along an inner surface of a ring, the size of gemstone diameter may not be limited by the ring width.

If a user selects that the gemstones will be of two sizes at Step 120, then the process will use the placement formula in Step 130. In Step 130, the process subtracts a minimum size of stamping area 40 from finger size circumference, and the difference is the available gemstone area. In one example, minimum size of stamping area 40 may be approximately 8 mm.

The process multiplies the number of locations for smaller gemstones by the minimum smaller gemstone size, then subtracts that amount from the available gemstone area to determine a first quantity. In one example, a 51 gemstone ring may have 40 smaller gemstones and minimum smaller gemstone size of 0.6 mm. The process divides the first quantity by the number of locations for larger gemstones to determine a larger gemstone size. In one example, a 51 gemstone ring may have 11 larger gemstones. It may be desirable to have larger gemstones at least 0.3 mm larger than smaller gemstones. Depending on factors, it may be possible to increase the smaller and larger gemstone sizes.

In another aspect, gemstone sizes may be determined using a predetermined minimum space between gemstones and a predetermined difference in gemstone size between smaller and larger gemstones. In one non-limiting example, minimum space between gemstones may be 0.1 mm and predetermined difference in gemstone size may be 0.3 mm. The number of smaller gemstones times the minimum space may be added to the number of larger gemstones times the minimum space plus predetermined difference, and this quantity subtracted from the available gemstone area to create a remaining area. The remaining area may be divided by the number of spaces between gemstones to produce a preliminary largest possible gemstone size for the smaller stones. The gemstone sizes may be adjusted to maintain relative size difference between the larger and smaller stones.

After Step 125 or Step 130, the process proceeds to Step 135 where the size of stamping area 40 may be increased by any additional space available after determining gemstone size above.

In Step 140, a style of stamping area 40 is implemented. In this example, one of three styles may be implemented. Step 145 indicates one stamping area 40. Step 150 indicates one stamping area 40 with one gemstone located within the stamping area 40. Alternatively, the total stamping area may be distributed across multiple stamping areas 40. Step 155 indicates two stamping areas, which may be contiguously arranged or may be arranged otherwise, for example, on opposite sides of ring.

If one gemstone size was selected in Step 115, then the process proceeds to Step 160, where gemstone parameters and placement are determined. The process will calculate the setting depth of the gemstones. The setting depth may be calculated to ensure the gemstone table is a predetermined depth, for example, 0.05 mm, below the inner surface of the ring 10. So doing may prevent the gemstones from damage and result in a more comfortable fit for the wearer.

Figure 20:
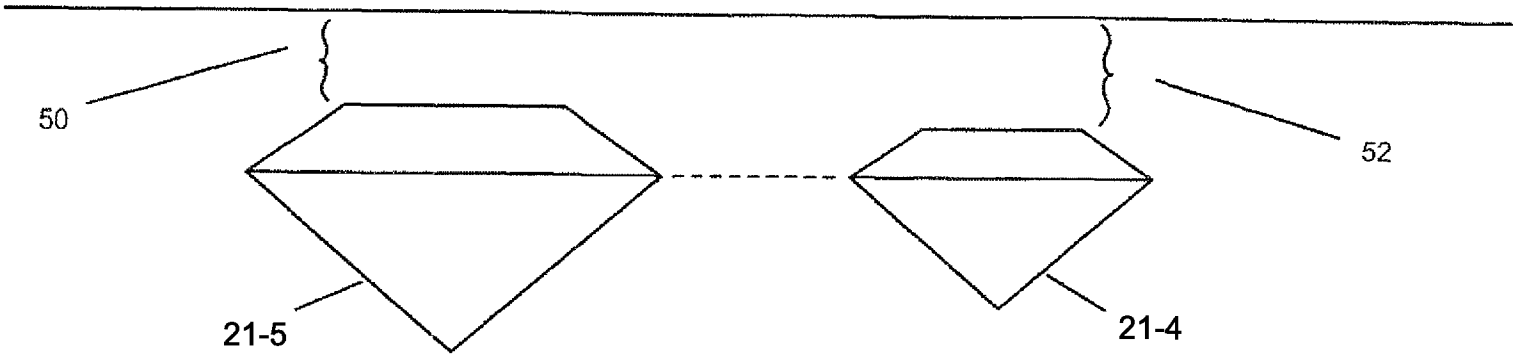
FIG. 20 shows a side, cross-section view of gemstones in a ring of the present disclosure.

If two gemstone size were selected in Step 120, then the process proceeds to Step 165, where the process calculates setting depth. The setting depth may be calculated to ensure the gemstone table of the larger gemstones are a predetermined depth, for example, 0.05 mm, below the inner surface of the ring 10. As shown in FIG. 20, a smaller gemstone 21-4 may be set at a depth 52 such that the girdle of the smaller gemstone 21-4 is aligned with the girdle of a larger gemstone 21-5, as illustrated by the dashed horizontal line. For this to occur, depth 52 of smaller gemstone 21-4 may be larger than depth 50 of larger gemstone 21-5.

After Step 160 or Step 165, the process proceeds to Step 170 where the gemstone position is calculated. In this step, the process generates locations of the gemstones along the inner surface of the ring and generates measurements of those locations in degrees.

Once these calculations are performed, the locations may be marked on an inner surface of the ring 10.

Figure 22:
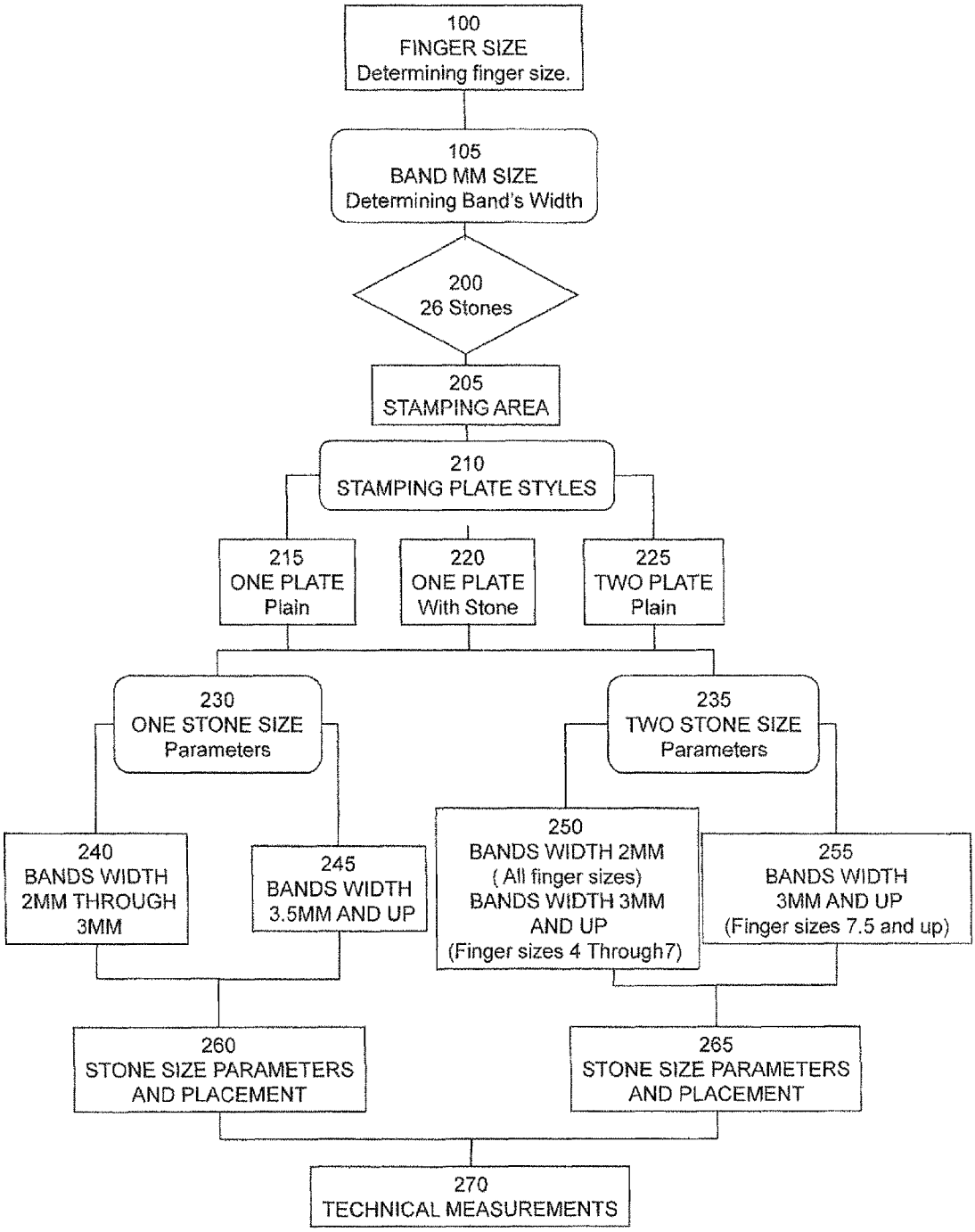

FIG. 22 shows a flowchart for a process for marking a ring for placement of 26 gemstones. As described above, user may input finger size (Step 100) and width of ring 10 (Step 105). Step 200 indicates this process will determine placement of 26 gemstones.

In Step 205, the process determines the stamping area. Due to the smaller quantity of gemstones in the 26 gemstone ring, there may be more space for stamping area 40 and spacing between gemstones. The stamping area 40 may be calculated using the minimum stamping area, for example, 8.0 mm from gemstone girdle to gemstone girdle, for a small ring size, then extrapolated for larger ring sizes as shown in FIG. 7. As shown in FIG. 7, total stamping area may be spread across two stamping areas 40 located opposite one another or elsewhere on the inner surface of the ring 10.

In Step 210, a style of stamping area 40 is implemented. In this example, one of three styles may be implemented. Step 215 indicates one stamping area 40. Step 220 indicates one stamping area 40 with one gemstone located within the stamping area 40. Alternatively, the total stamping area may be distributed across multiple stamping areas 40. Step 225 indicates two stamping areas, which may be contiguously arranged or may be arranged otherwise, for example, on opposite sides of ring.

If a user selects that all gemstones are the same size at Step 230, then the process may use the gemstone size selection in Step 240 for bands having width 2.0 mm through 3.0 mm or the process may use the gemstone size selection formula in Step 245 for bands having width 3.5 mm and larger.

In Step 240, maximum gemstone sizes may be selected by keeping a minimum distance, for example, of 0.4 mm, from gemstone girdle to the edge of the ring. This is to allow the gemstone to fit and be set within the ring and prevent damage to the ring. Maximum gemstone sizes may also be selected so that there is at least 0.1 mm girdle-to-girdle between gemstones.

In Step 245, because the larger width of the ring, maximum gemstone sizes may be selected so that there is at least 0.1 mm girdle-to-girdle between gemstones.

Once gemstone sizes for one gemstone size arrangements have been determined, the process moves to Step 260.

In Step 260, the process subtracts a stamping area size from finger size circumference, then divides that amount by the number of spaced between gemstones, in this case 25, yielding the maximum gemstone size subject to rules laid out in Steps 245 and 245. The process then equally spaces the gemstones leaving a predetermined distance between the gemstones, for example, 0.1 mm. The process will calculate the setting depth of the gemstones. The setting depth may be calculated to ensure the gemstone table is a predetermined depth, for example, 0.05 mm, below the inner surface of the ring 10. So doing may prevent the gemstones from damage and result in a more comfortable fit for the wearer.

If a user selects that the gemstones will be of two sizes (Step 235), then the process will use the gemstone size selection in Step 250 for bands having width 2.0 mm (all finger sizes) or 3.0 mm and up (finger sizes 4-7) or the process will use the gemstone size selection formula in Step 255 for bands having width 3.0 mm and larger (finger sizes 7.5 and up).

In Step 250, the size difference between the small gemstone and large gemstone may be 0.3 mm for 2.0 mm ring widths and maximum gemstone size may be restricted by width of the ring that must allow 0.4 mm from girdle to ring edge. For example, a ring of 2.0 mm width may have a maximum gemstone size of 1.1 mm allowing for 0.4 mm at top and bottom of gemstone, plus 0.1 mm to allow for any cylindrical (non-square) ring shape. For rings having 3.0 mm width and up and finger sizes 4 though 6.5, the size difference between the small gemstone and large gemstone may be 0.3 mm, with small gemstones at 1.5 mm maximum and large gemstones 1.8 mm maximum. For rings having 3.0 mm width and up and finger size 7, the size difference between the small gemstone and large gemstone may be 0.4 mm, with small gemstones at 1.5 mm maximum and large gemstones 1.9 mm maximum.

In Step 255, for finger sizes 7.5 and up, the size difference between the small gemstone and large gemstone may be 0.3 mm for small gemstones smaller than and equal to 1.5 mm, and the difference may be 0.4 mm for small gemstones larger than 1.5 mm. Once gemstone sizes for two gemstone size arrangements have been determined, the process moves to Step 265.

For rings of 3.0 mm width and finger size 9 and up, gemstone size may be restricted by width of the ring that must allow 0.4 mm from girdle to ring edge. For rings of 3.0 mm width and below finger size 9 and for rings of width greater than 3.0 mm, gemstone size is restricted by minimum 0.1 mm girdle-to-girdle proximity.

In Step 265, the process subtracts a size of stamping area 40 from finger size circumference, and the difference is the available gemstone area. In one example, minimum, size of stamping area 40 may be approximately 8 mm.

The process multiplies the number of locations for smaller gemstones by the minimum smaller gemstone size, then subtracts that amount from the available gemstone area to determine a first quantity. In one example, a 26 gemstone ring may have 20 smaller gemstones and minimum smaller gemstone size of 0.6 min. The process divides the first quantity by the number of locations for larger gemstones to determine a larger gemstone size. In one example, a 26 gemstone ring may have 6 larger gemstones. It may be desirable to have larger gemstones at least 0.3 mm larger than smaller gemstones. Depending on factors, it may be possible to increase the smaller and larger gemstone sizes.

In this step, the process also calculates setting depth. The setting depth may be calculated to ensure the gemstone table of the larger gemstones are a predetermined depth, for example, 0.05 mm, below the inner surface of the ring 10. The smaller gemstones are set at a depth such that the girdle of the smaller gemstone is aligned with the girdle of the larger gemstone, as shown in FIG. 20.

After Step 160 or Step 165, the process proceeds to Step 170 where the gemstone position is calculated. In this step, the process generates locations of the gemstones along the inner surface of the ring and generates measurements of those locations in degrees.

Once these calculations are performed, the locations may be marked on an inner surface of the ring 10.

Figure 23:
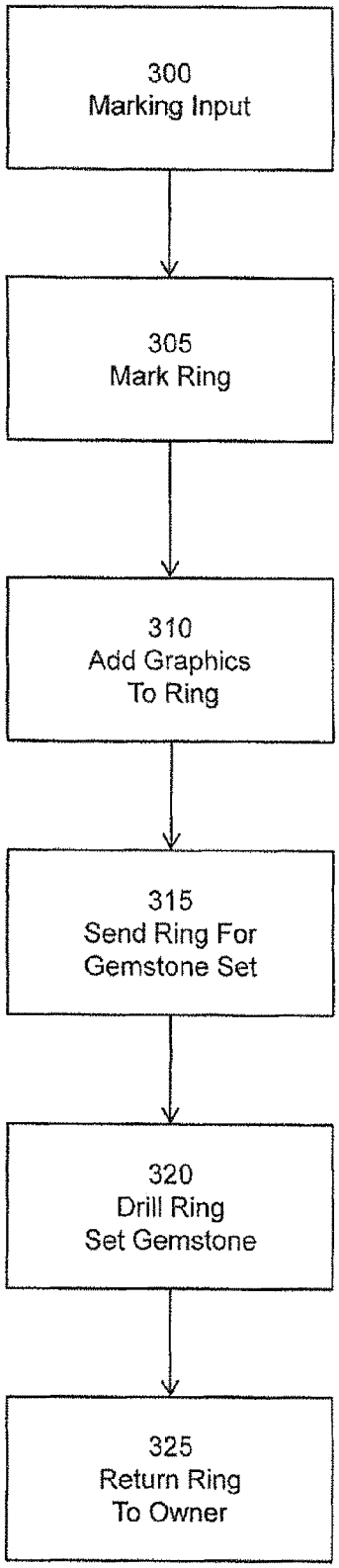
FIG. 23 is a flowchart according to an aspect of the method of the present disclosure.

FIG. 23 is a flowchart of the process of marking the ring 10. In Step 300, the process may receive as input, stamping area size and type, marking locations, marking types, and marking sizes for a specific finger size into control software. In one aspect, software such as Visual LaserStar Write (VLW) may be used control a laser engraving system such as a Crawford-LaserStar Technologies 6-watt Marking Laser, 3700 Series. In other aspects, marks may be made by a CNC machine. In Step 305, ring 10 may be inserted into the laser engraving system and the system may engrave the markings. In Step 310, graphics, such as text, may be optionally engraved in one or more the stamping areas.

Some time after Step 305, at Step 315, the ring 10 may be sent to an authorized individual or business to set a gemstone in ring 10. At Step 320, a milling machine may be used to drill a hole at one or more markings to accommodate a gemstone. The markings, including marking size, type, and locations, may be used as a guide for drilling the hole size and location. A gemstone may be set into the hole. At Step 325, ring 10 may be returned to the owner and the process may be repeated upon the next event or anniversary.

Numerous additional modifications and variations of the present disclosure are possible in view of the above teachings. It is therefore to be understood that within the scope of the appended claims, the present disclosure may be practiced other than as specifically described herein.

The invention claimed is:

1. A method of augmenting a ring by determining locations for the proportional placement of gemstones on portions of an inner surface of received ring shanks of varying finger sizes, where the markings identify center points for the placement of gemstones, where the shank includes one or more marking areas and one or more non-marking areas, and where the gemstones are of one or more sizes, the method comprising:

a) determining an available gemstone marking area based on an inner shank circumference, a number of non-marking areas, and a minimum size of each non-marking area;

b) determining a number of spaces between markings based on a quantity of gemstone markings, a number of gemstone sizes, the inner shank circumference, the number of non-marking areas, and the minimum size of each non-marking area;

c) determining, if a number of gemstone sizes is one, a gemstone size based on a difference between the available gemstone marking area and a product of the number of spaces between markings and a predetermined minimum space between markings, where the gemstone size allows at least 0.1 mm between girdles of adjacent gemstones, and, for ring shanks of 2 mm through 3 mm width, the gemstone size allows at least 0.4 mm from a gemstone girdle to an edge of the ring shank;

d) determining, if the number of gemstone sizes is two, a larger gemstone size and a smaller gemstone size based on one or more of the following: a quantity of smaller gemstones, a quantity of larger gemstones, the predetermined minimum space between markings, the available gemstone marking area, the number of spaces between markings, and a difference between the larger gemstone size and the smaller gemstone size, wherein d1) when the width of the ring shank is 2 mm, the larger gemstone size is at least 0.3 mm larger than the smaller gemstone size, and the larger gemstone size and smaller gemstone size allow at least 0.4 mm from gemstone girdle to the edge of the ring shank;

d2) when the width of the ring shank is 3 mm or greater, and the finger size is 4 through 6.5, the larger gemstone size is at most 1.8 mm and is at least 0.3 mm larger than the smaller gemstone size;

d3) when the width of the ring shank is 3 mm or greater, and the finger size is 7, the larger gemstone size is at most 1.9 mm and is at least 0.4 mm larger than the smaller gemstone size;

d4) when the width of the ring shank is 3 mm or greater, and the finger size is 7.5 or greater, the larger gemstone size is at least 0.3 mm larger than the smaller gemstone size when the smaller gemstone size is 1.5 mm or less, and the larger gemstone size is at least 0.4 mm larger than the smaller gemstone size when the smaller gemstone size is 1.6 mm or greater;

e) determining locations for markings within the one or more marking areas along the inner surface of the shank based on the quantity of gemstone markings, the determined gemstone sizes, the inner shank circumference, the number of non-marking areas, and the minimum size of each non-marking area;

f) marking the inner surface of the shank according to the determined locations for the markings; and g) creating a setting having a size and position defined by at least one of the markings.

2. The method of claim 1, further comprising: inserting the gemstone into the setting.

3. The method of claim 1, wherein the gemstone in the setting is not visible when the ring is worn on a finger.

4. The method of claim 1, wherein determining the larger gemstone size includes:

determining a first quantity equal to a difference between the size of each marking area and a product of the number of smaller gemstones and the smaller gemstone size; and determining the larger gemstone size equal to a quotient of the first quantity and the number of larger gemstones.

5. The method of claim 4, wherein determining the smaller gemstone size includes:

1) determining a first quantity equal to the sum of:

the difference between the larger gemstone size and the smaller gemstone size, a product of the number of smaller gemstones and the predetermined minimum space, and a product of the number of larger gemstones and the predetermined minimum space;

2) determining a remaining area equal to a difference between the available gemstone marking area and the first quantity; and 3) determining the smaller gemstone size equal to a quotient of the remaining area and the number of spaces between markings.

6. The method of claim 5, further comprising determining, if the quantity of gemstone sizes is two:

a setting depth for the larger gemstone sizes where the larger gemstones are below an inner surface of the ring, and a setting depth for the smaller gemstone sizes where a girdle of the smaller gemstone sizes are aligned with a girdle of the larger gemstone sizes.

7. The method of claim 1, further comprising determining, if the quantity of gemstone sizes is one, a setting depth for the gemstones such that the gemstones are a predetermined distance below an inner surface of the ring.

8. The method of claim 1, wherein:

if the ring width is between 2 and 3 mm, determining the gemstone size further comprises limiting the gemstone size such that a minimum distance from a gemstone girdle to an edge of the ring is equal to 0.4 mm; and if the width of the ring is greater than 3.5 mm, determining the gemstone size further comprises limiting the gemstone size such that a minimum distance between the girdles of the adjacent gemstones is 0.1 mm.

9. The method of claim 1, wherein if the width of the ring is 2 mm, the predetermined difference between the larger gemstone size and the smaller gemstone size is equal to 0.3 mm, and determining the gemstone size further comprises limiting the larger gemstone size such that a minimum distance from a larger gemstone girdle to an edge of the ring is equal to 0.4 mm.

10. The method of claim 1, wherein if the width of the ring is 3 mm or greater and the finger size is between 4 and 7, then the predetermined difference in size between the between the larger gemstone size and the smaller gemstone size is equal to 0.3 mm; and determining the larger gemstone size further comprises limiting the larger gemstone size such that a minimum distance from a larger gemstone girdle to an edge of the ring is equal to 0.4 mm.

11. The method of claim 1, wherein if the width of the ring is 3 mm, the predetermined difference between the larger gemstone size and the smaller gemstone size is equal to:

0.3 mm for gemstones smaller than and equal to 1.5 mm; and 0.4 mm for gemstones larger than 1.5 millimeters.

12. The method of claim 1, further comprising, after step d), updating the size of each non-marking area based on the minimum size of the non-marking area and the calculated gemstone sizes.

13. A method of augmenting a ring, the method comprising:

a) receiving the ring having markings on the inner surface thereof, where locations of the markings were determined by:

1) determining an available gemstone marking area based on an inner shank circumference, a number of non-marking areas, and a minimum size of each non-marking area;

2) determining a number of spaces between markings based on a quantity of gemstone markings, a number of gemstone sizes, the inner shank circumference, the number of non-marking areas, and the minimum size of each non-marking area;

3) determining, if a number of gemstone sizes is one, a gemstone size based on a difference between the available gemstone marking area and a product of the number of spaces between markings and a predetermined minimum space between markings, where the gemstone size allows at least 0.1 mm between girdles of adjacent gemstones, and, for ring shanks of 2 mm through 3 mm width, the gemstone size allows at least 0.4 mm from a gemstone girdle to an edge of the ring shank;

4) determining, if the number of gemstone sizes is two, a larger gemstone size and a smaller gemstone size based on one or more of the following: a quantity of smaller gemstones, a quantity of larger gemstones, the predetermined minimum space between markings, the available gemstone marking area, the number of spaces between markings, and a difference between the larger gemstone size and the smaller gemstone size, wherein 4.1) when the width of the ring shank is 2 mm, the larger gemstone size is at least 0.3 mm larger than the smaller gemstone size, and the larger gemstone size and smaller gemstone size allow at least 0.4 mm from gemstone girdle to the edge of the ring shank;

4.2) when the width of the ring shank is 3 mm or greater, and the finger size is 4 through 6.5, the larger gemstone size is at most 1.8 mm and is at least 0.3 mm larger than the smaller gemstone size;

4.3) when the width of the ring shank is 3 mm or greater, and the finger size is 7, the larger gemstone size is at most 1.9 mm and is at least 0.4 mm larger than the smaller gemstone size;

4.4) when the width of the ring shank is 3 mm or greater, and the finger size is 7.5 or greater, the larger gemstone size is at least 0.3 mm larger than the smaller gemstone size when the smaller gemstone size is 1.5 mm or less, and the larger gemstone size is at least 0.4 mm larger than the smaller gemstone size when the smaller gemstone size is 1.6 mm or greater;

5) determining locations for markings within the one or more marking areas along the inner surface of the shank based on the quantity of gemstone markings, the determined gemstone sizes, the inner shank circumference, the number of non-marking areas, and the minimum size of each non-marking area; and 6) marking the inner surface of the shank according to the determined locations for the markings;

b) creating a setting having a size and position defined by at least one of the markings; and c) placing a gemstone in the setting.

* * * * *